US008919461B2

(12) United States Patent
John

(10) Patent No.: US 8,919,461 B2
(45) Date of Patent: Dec. 30, 2014

(54) WELL TOOL HAVING A NANOPARTICLE REINFORCED METALLIC COATING

(75) Inventor: Hendrik John, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 555 days.

(21) Appl. No.: 13/186,549

(22) Filed: Jul. 20, 2011

(65) Prior Publication Data

US 2012/0018141 A1 Jan. 26, 2012

Related U.S. Application Data

(60) Provisional application No. 61/366,526, filed on Jul. 21, 2010.

(51) Int. Cl.

| | |
|---|---|
| ***E21B 10/46*** | (2006.01) |
| ***E21B 17/10*** | (2006.01) |
| ***C23C 30/00*** | (2006.01) |
| ***E21B 4/02*** | (2006.01) |

(52) U.S. Cl.

CPC ..... *E21B 4/02* (2013.01); *E21B 17/1085* (2013.01); *C23C 30/005* (2013.01); *C23C 30/00* (2013.01)

USPC ..... 175/425

(58) Field of Classification Search

USPC ..... 175/425, 426, 434, 433

See application file for complete search history.

(56) References Cited

U.S. PATENT DOCUMENTS

| | | | | |
|---|---|---|---|---|
| 3,065,535 | A * | 11/1962 | Talmey et al. | 228/199 |
| 6,258,417 | B1 * | 7/2001 | Goswami et al. | 427/452 |
| 6,742,586 | B2 | 6/2004 | Lauritzen et al. | |
| 7,998,573 | B2 * | 8/2011 | Qian et al. | 428/325 |
| 8,220,563 | B2 * | 7/2012 | Bangaru et al. | 175/57 |
| 8,261,841 | B2 * | 9/2012 | Bailey et al. | 166/380 |
| 8,286,715 | B2 * | 10/2012 | Bailey et al. | 166/380 |
| 2002/0192479 | A1 * | 12/2002 | Goswami et al. | 428/469 |
| 2003/0229399 | A1 * | 12/2003 | Namavar | 623/23.53 |
| 2007/0151769 | A1 * | 7/2007 | Slutz et al. | 175/426 |
| 2008/0093047 | A1 | 4/2008 | Ma et al. | |
| 2008/0127475 | A1 * | 6/2008 | Griffo | 29/33 K |
| 2008/0129044 | A1 * | 6/2008 | Carcagno et al. | 285/94 |
| 2009/0050314 | A1 * | 2/2009 | Holmes | 166/242.1 |

(Continued)

FOREIGN PATENT DOCUMENTS

WO WO 2013050876 A2 * 4/2013

OTHER PUBLICATIONS

Zemanova et al., NiW alloy coating deposited from a citrate electrolyte, Oct. 22, 2011.*

(Continued)

*Primary Examiner* — Kenneth L Thompson

(74) *Attorney, Agent, or Firm* — Cantor Colburn LLP

(57) ABSTRACT

A well tool is disclosed. The tool includes a first member having a surface that is configured for exposure to a well fluid, the first member comprising a metallic coating disposed on a substrate, the metallic coating having a plurality of dispersed nanoparticles disposed therein and providing the surface. The tool also includes a second member that is disposed in slidable engagement on the surface of the first member. In another exemplary embodiment, a well tool includes a first member having a surface that is configured for exposure to a well fluid, the first member comprising a metallic alloy, the metallic alloy having a plurality of dispersed nanoparticles disposed therein and providing the surface.

25 Claims, 3 Drawing Sheets

(56) References Cited

U.S. PATENT DOCUMENTS

| | | | | |
|---|---|---|---|---|
| 2009/0152009 | A1 | 6/2009 | Slay et al. | |
| 2009/0194339 | A1 | 8/2009 | Dick et al. | |
| 2010/0108393 | A1 | 5/2010 | John et al. | |
| 2010/0300750 | A1* | 12/2010 | Hales et al. | 175/2 |
| 2011/0171414 | A1* | 7/2011 | Sreshta et al. | 428/64.1 |
| 2011/0200825 | A1* | 8/2011 | Chakraborty et al. | 428/412 |
| 2012/0024109 | A1* | 2/2012 | Xu et al. | 75/243 |
| 2012/0103135 | A1* | 5/2012 | Xu et al. | 75/233 |
| 2012/0199357 | A1* | 8/2012 | Seth et al. | 166/310 |
| 2012/0292117 | A1* | 11/2012 | John et al. | 175/428 |
| 2013/0108800 | A1* | 5/2013 | Chakraborty et al. | 427/535 |
| 2013/0216777 | A1* | 8/2013 | Jiang et al. | 428/141 |
| 2013/0299249 | A1* | 11/2013 | Weaver et al. | 175/428 |

OTHER PUBLICATIONS

International Search Report dated Jul. 21, 2011, International Application No. PCT/US2011044850.

Written Opinion of International Searching Authority dated Jul. 21, 2011, International Application No. PCT/US2011044850.

International Preliminary Report on Patentability issued on Jan. 22, 2013 for International application No. PCT/US2011/044850 filed on Jul. 21, 2011.

W.X. Chen, J.P. Tu, H.Y. Gan, Z.D. Xu, Q.G. Wang, J.Y. Lee, Z.L. Liu, X.B. Zhang, "Electroless preparation and tribiological properties of Ni—P—Carbon nanotube composite coatings under lubricated condition", Surface and Coatings Technology 160 (2002) 68-73.

W.X. Chen, J.P. Tu, Z.D. Xu, W.L. Chen, X.B. Zhang, D.H. Cheng, "Tribological properties of Ni—P-multi-walled carbon nanotubes electroless composite coating", Material Letters 57 (2003) 1256-1260.

X.H. Chen, C.S. Chen, H.N. Xiao, H.B. Liu, L.P. Zhou, S.L. Li, G. Zhang, "Dry friction and wear characteristics of nickel/carbon nanotube electroless composite deposits", Tribology International 39 (2006) 22-28.

J.J. Kelly, N.Y.C. Yang, "Electrodeposition of NI from a Sulfamate Electrolyte", Sand Report, Sandia National Laboratories, Sand2001-8609, Oct. 2001.

Byengsoo Lim, Chul-ju Kim, Bumjoon Kim, Untae Shim, Seyoung Oh, Byung-ho Sung, Jee-hoon Choi, Seunghyun Baik, "The effects of interfacial bonding on mechanical properties of single-walled carbon nanotube reinforced copper matrix nanocomposites", Nanotechnology 17 (2006) 5759-5764.

Lakshmikanth Namburi, "Electrodeposition on NiW Alloys Into Deep Recesses", A Thesis, Submitted to the Graduate Faculty of the Louisiana State University and Agricultural and Mechanical College, Dec. 2001.

Pin-Qiang Dai, Wei-Chang Xu, Qing-Ya Huang, "Mechanical properties and microstructure of nanocrystalline nickel—carbon nanotube composites produced by electrodeposition", Materials Science and Engineering A 483-484 (2008) 172-174.

Susumu Arai, Akihiro Fujimori, Masami Murai, Morinobu Endo, "Excellent solid lubrication of electrodeposited nickel-multiwalled carbon nanotube composite films", Materials Lettters 62 (2008) 3545-3548.

J. Tan, T. Yu, B.Xu and Q. Yao, "Microstructure and wear resistance of nickel—carbon nanotube composite coating from brush plating technique", Tribology Letters, vol. 21, No. 2 Feb. 2006.

Tzu-Yuan Chao, Guang-Ren Shen, Y.T. Cheng "Comparative Study of Ni—P-Diamond and Ni—P—CNT Nanocomposite Films", Journal of Electrochemical Society, 153, (1) G98-G104 (2006).

* cited by examiner

WELL TOOL HAVING A NANOPARTICLE REINFORCED METALLIC COATING

CROSS-REFERENCES TO RELATED APPLICATIONS

This patent application claims priority to U.S. Provisional Patent Application Ser. No. 61/366,526, filed Jul. 21, 2010, which is incorporated herein by reference in its entirety.

BACKGROUND

Well operations, including well drilling, production or completion operations, particularly for oil and natural gas wells, utilize various uphole and downhole well components and tools, particularly rotatable components and tools, which must maintain a high abrasion resistance and a low coefficient of sliding friction under extreme conditions, such as, high temperatures and high pressures for their efficient operation. These include many types of rotatable rotors, shafts, bushings, bearings, sleeves and other components that include surfaces that are in slidable engagement with one another. These high temperatures can be elevated further by heat generated by the components and tools themselves, particularly those that are used in the downhole operations. Mud motors, for example, can generate additional heat during their operation. Materials used to fabricate the various uphole and downhole well components and tools used in well drilling, production or completion operations are therefore carefully chosen for their ability to operate, often for long periods of time, in these extreme conditions.

In order to maintain a high abrasion resistance and a low coefficient of sliding friction these components and tools frequently employ a surface coating, such as various chromium hardcoats. While such coatings are generally effective to provide the desired abrasion resistance and coefficient of sliding friction, they are known to be susceptible to corrosion upon exposure to various well environments, particularly fluids that include chlorides.

Therefore, the development of materials that can be used to form well components and tools having the desired combination of high abrasion resistance and low coefficient of sliding friction, as well as high corrosion resistance, particularly in chloride environments, is very desirable.

SUMMARY

An exemplary embodiment of a well tool is disclosed. The tool includes a first member having a surface that is configured for exposure to a well fluid, the first member comprising a metallic coating disposed on a substrate, the metallic coating having a plurality of dispersed nanoparticles disposed therein and providing the surface. The tool also includes a second member that is disposed in slidable engagement on the surface of the first member.

BRIEF DESCRIPTION OF THE DRAWINGS

Referring now to the drawings wherein like elements are numbered alike in the several Figures.

DETAILED DESCRIPTION

Figure 1:
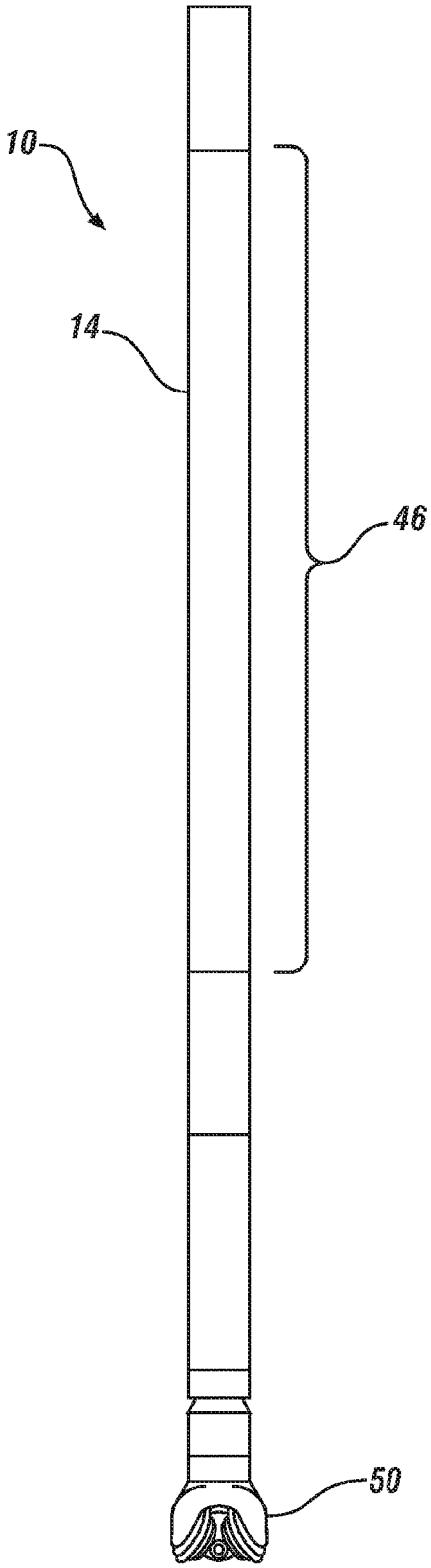
FIG. 1 depicts a side view of an exemplary embodiment of a tool as disclosed herein in the form of a mud motor.
Figure 2:
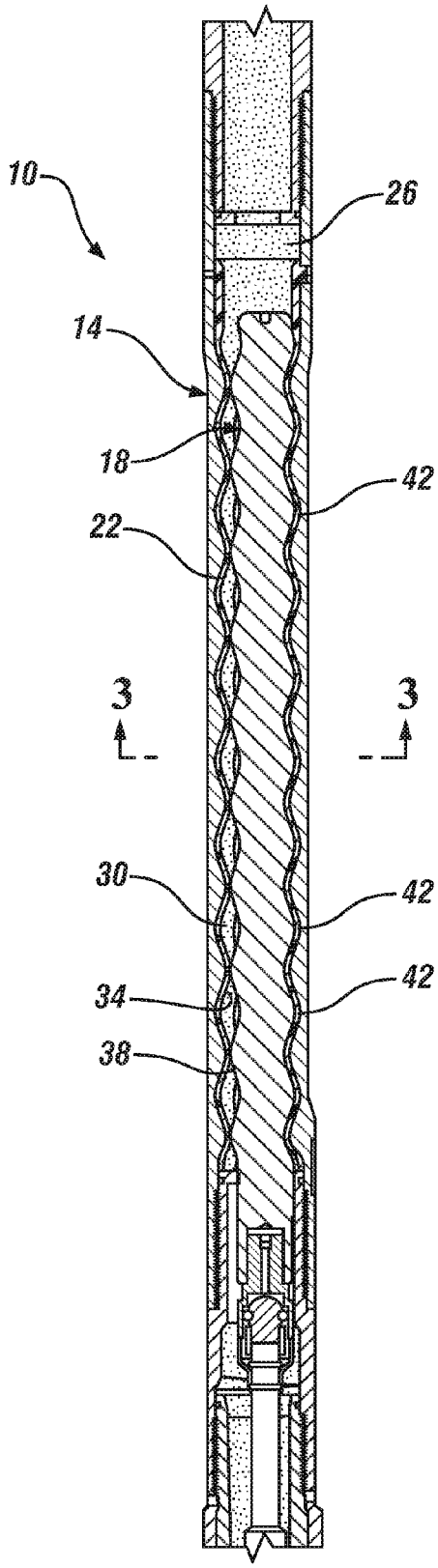
FIG. 2 depicts a cross sectional view of the mud motor of FIG. 1.

A detailed description of one or more embodiments of the disclosed apparatus and method are presented herein by way of exemplification and not limitation with reference to the Figures.

Referring to FIGS. 1-4, an exemplary embodiment of a component or well tool 1, such as may be used for well operations, including well production or completion, as disclosed herein, is illustrated with reference to a mud motor 10. The tool 1 includes a first member 2 having a surface 5 that is configured for exposure to a well fluid 26, such as a drilling mud. The first member 2 includes a metallic coating 6 disposed on a substrate 15. The metallic coating 6 has a plurality of dispersed nanoparticles 7 disposed therein and provides the surface 5. Alternately, in another embodiment, the well tool 1, may includes a first member 2 having a surface 5 that is configured for exposure to a well fluid 26, the first member comprising a metallic alloy, the metallic alloy having a plurality of dispersed nanoparticles 7 disposed therein and providing the surface 5. In this embodiment, rather than employing a coating, the metallic alloy comprises the first member 2. The tool 1 may also optionally include a second member 8 that is disposed in slidable engagement on the surface 5 of the first member 2. This describes a relationship that exists generally between components of many well tools 1 used in well operations; including components of various pump and drill configurations. The metallic coating 6 described herein may be used in any well tool 1 that includes a combination of a second member 8 that is disposed in slidable engagement on the surface 5 of the first member 2, particularly various drill string components, including drills, pumps, mud motors, logging while drilling (LWD) devices or measurement while drilling (MWD) devices and is illustrated more particularly herein in conjunction with a mud motor 10. This includes many sliding surface or wear surface applications and configurations, including various planar and non-planar configurations, such as various shafts, rotors, bushings, bearings, sleeves, electrical contacts and wear surfaces, which require wear resistance, corrosion resistance and a low coefficient of sliding friction.

The mud motor 10 includes a stator 14, a rotor 18 and a polymer sleeve 22 that conforms to the inner surface 17 of the stator 14 and is positioned between the stator 14 and the rotor 18. Polymer sleeve 22 may include any suitable polymer material 24. In an exemplary embodiment, polymer material 24 may include an elastomeric polymer material 24, particularly various forms of rubber, including nitrile or acrylonitrile butadiene rubber. Mud 26 is pumped through the mud motor 10 and flows through cavities 30 defined by clearances between lobes 34 of the stator 14 and the elastomer and lobes 38 of the rotor 18. The mud 26 that is pumped through the cavities 30 causes the rotor 18 to rotate relative to the stator 14 and the polymer sleeve 22. The flow of the mud 26 through the cavities 30 creates eccentric motion of the rotor 18 in the power section 46 of mud motor 10 which is transferred as concentric power to the drill bit 50. The polymer sleeve 22 is affixed to the stator 14 and sealingly engaged with both the stator 14 and the rotor 18 to reduce leakage at contact points between them along their length and enhance the performance and efficiency of the mud motor 10 otherwise known as a progressive cavity positive displacement pump. The operating environment of the stator 14, polymer sleeve 22 and rotor 18 is a high pressure, high temperature environment, including pressures up to about 5 MPa, and in some applications up to about 8 MPa, and temperatures up to about 250° C., and surface 5 is in contact with various well fluids 26, such as drilling mud, including those which contain high concentrations of chlorides. The surface 5 of rotor 18 has a predetermined surface finish. It is imperative to the operating efficiency of mud motor 10 to maintain the overall condition and predetermined surface finish of surface 5 in order to maintain a predetermined coefficient of sliding friction between rotor 18 and polymer sleeve 22, particularly a low coefficient of sliding friction to reduce wear and other degradation of the polymer sleeve 22. The metallic coating 6 disclosed herein is configured to maintain a predetermined coefficient of sliding friction in the high pressure, high temperature environment described, even when the well fluids 26, such as drilling mud, contain high concentrations of chlorides.

Figure 3:
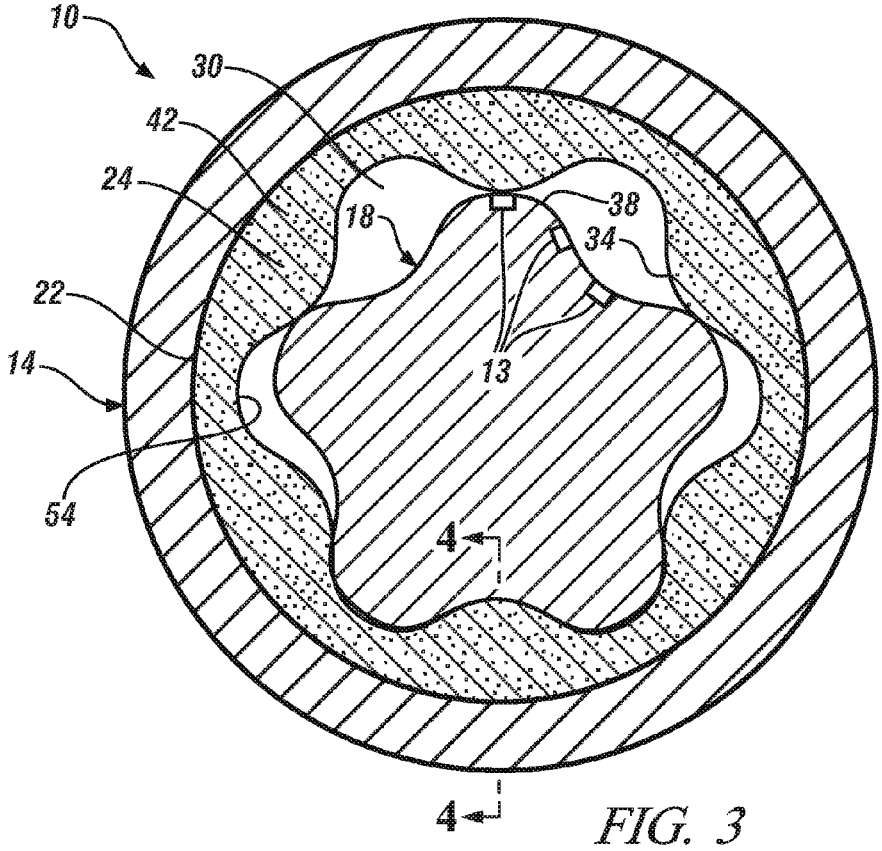
FIG. 3 depicts a cross sectional view of the mud motor of FIG. 2 taken along Section 3-3.
Figure 4:
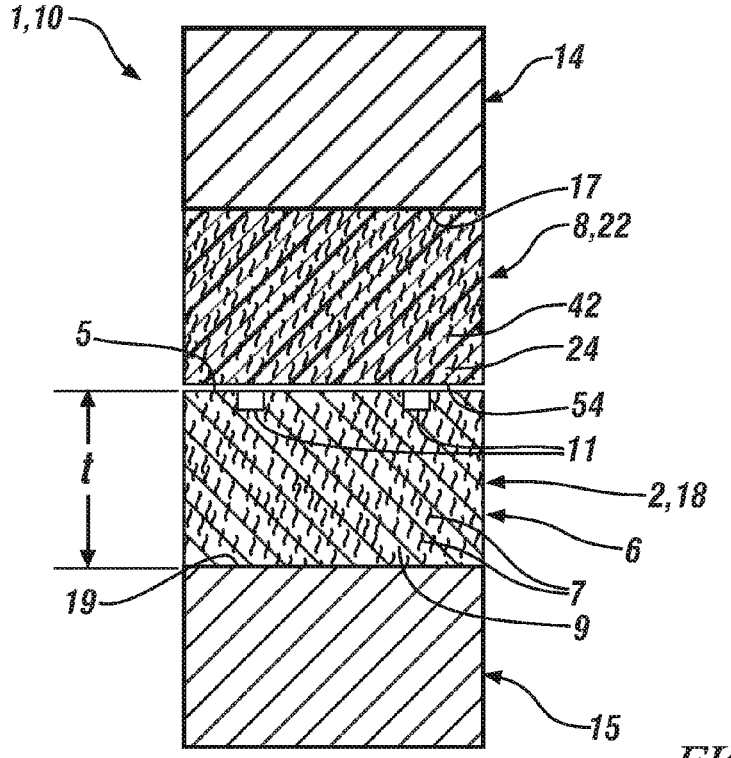
FIG. 4 is a cross-sectional view of the mud motor of FIG. 3 taken along Section 4-4.
Figure 5:
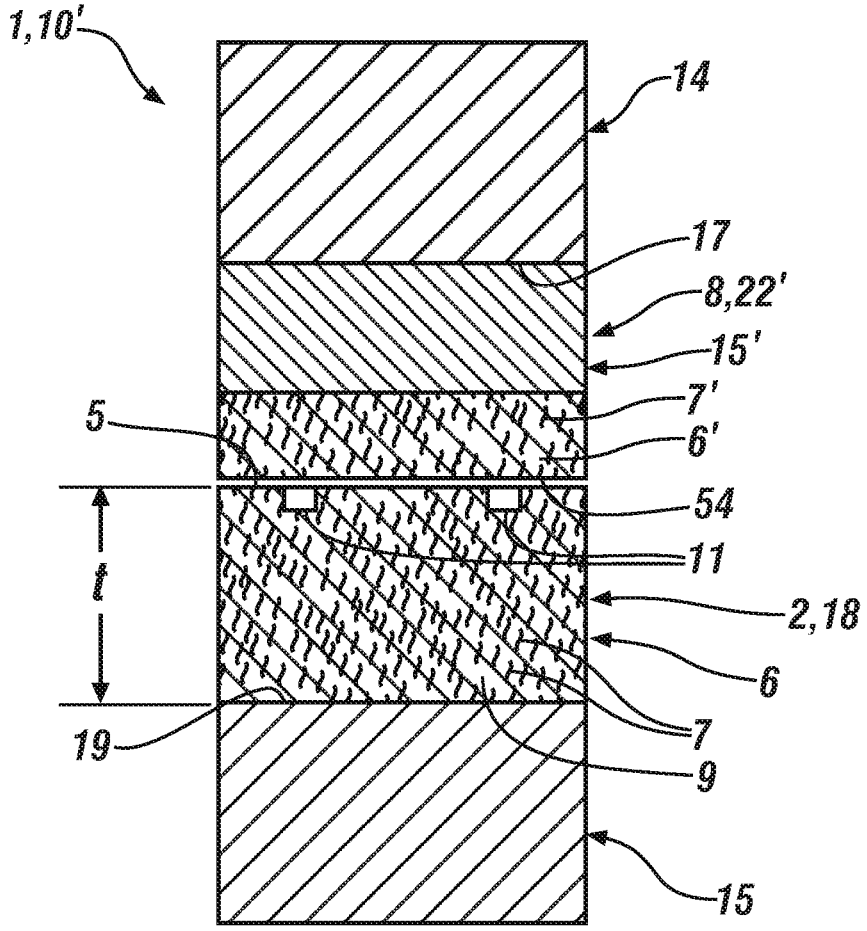
FIG. 5 is a cross-sectional view of another exemplary embodiment of a mud motor analogous to the section shown in FIG. 4.

Referring generally to FIGS. 1-5, and more particularly to FIG. 5, in another exemplary embodiment, the polymer sleeve 22 may be replaced with a metal sleeve 22' that conforms to the inner surface 17 of the stator 14 and is positioned between the stator 14 and the rotor 18, which may in certain embodiments be formed of the same material as rotor 18, as described herein. The metal sleeve 22' may include a metallic coating 6' on the surface 54'. The metallic coating 6' may comprise the same metallic material 9' as employed for the metallic material 9 of metallic coating 6, as disclosed herein, or may include a different metallic material. Similarly, the metallic coating 6' may comprise the same nanoparticles 7' and amounts as employed for the nanoparticles 7 and amounts of metallic coating 6, as disclosed herein, or may include different nanoparticles. Tools 1, including mud motors 10', having this configuration that includes a first member 2 having a surface 5 that is configured for exposure to a well fluid 26, such as a drilling mud, and a second member 8' that is disposed in slidable engagement on the surface 5 of the first member 2, where the first member 2 includes a metallic coating 6 having a plurality of dispersed nanoparticles 7 disposed on a substrate 15, and where the second member 8 may also include a metallic coating 6' having a plurality of dispersed nanoparticles 7' disposed on a substrate 15', are particularly well suited for use in high temperature, high pressure well operations, including those performed at operating temperatures greater than 200° C., and more particularly at operating temperatures greater than 250° C., and even more particularly temperatures up to about 300° C., and pressures up to about 276 MPa.

Referring to FIGS. 2-5, first member 2 in the form of rotor 18 includes rotor substrate 15 that has metallic coating 6 disposed on an outer surface 19 thereof. Rotor substrate 15 and surface 19 may include any suitable rotor material 21, including various grades of steel. Referring to FIG. 4, metallic coating 6 may have any suitable thickness (t), including a thickness of up to about 150 μm, and more particularly from about 25 μm to about 150 μm.

The metallic coating 6 may include Ni, Cu, Ag, Au, Sn, Zn or Fe, or alloys of these metals, or a combination that includes at least one of these materials. In one exemplary embodiment, the metallic coating 6 may include any suitable metallic material 9 that includes Ni at the surface 5, including metallic materials 9 that include another element or elements wherein Ni is not the majority constituent element, or even the primary constituent element. In another exemplary embodiment, the metallic coating 6 includes an Ni-base alloy, where Ni is the majority constituent element by weight or atom percent. In another exemplary embodiment, metallic coating 6 includes an Ni—P alloy, and more particularly an Ni—P alloy that includes about 14 percent or less by weight P and the balance Ni and trace impurities. In yet another exemplary embodiment, metallic coating 6 includes an Ni—W alloy, and more particularly an Ni—W alloy (or W—Ni alloy) that includes up to about 76 percent by weight of tungsten, and more particularly up to about 30 percent by weight of tungsten. In certain embodiments, this may include about 0.1 to about 76 percent by weight of tungsten, and more particularly about 0.1 to about 30 percent by weight of tungsten. The trace impurities will be those known conventionally for Ni and Ni alloys based on the methods employed to process and refine the constituent element or elements. Metallic material 9 may be described as a metal matrix in which the dispersed nanoparticles 7 are disposed to form metallic coating 6, such that the coating comprises a metal matrix composite.

Metallic coating 6 also includes a plurality dispersed nanoparticles 7 that are dispersed within a metallic material 9. The nanoparticles 7 may be dispersed as a homogenous dispersion or a heterogeneous dispersion within the metallic material 9. The nanoparticles 7 may be provided in any suitable amount relative to the coating material 9, particularly up to about 28% by volume of the coating, more particularly from about 5% to about 28% by volume of the coating, and even more particularly from about 5% to about 12% by volume of the coating. The nanoparticles may comprise any suitable nanoparticle material, including carbon, boron, a carbide, a nitride, an oxide, a boride or a solid lubricant, including $MoS_2$, BN, or polytetrafluoroethylene (PTFE) solid lubricants, or a combination thereof. These may include any suitable carbides, nitrides, oxides and borides, particularly metallic carbides, nitrides, oxides and borides. Carbon nanoparticles may include any suitable form thereof, including various fullerenes or graphenes. Fullerenes may include those selected from the group consisting of buckeyballs, buckeyball clusters, buckeypaper, single-wall nanotubes or multi-wall nanotubes, or a combination thereof. The use of nanoparticles comprising single-wall and multi-wall carbon nanotubes is particularly useful. The single-wall and multi-wall carbon nanotubes may have any suitable tube diameter and length, including an outer diameter of about 1 nm or more (e.g., single wall carbon nanotube), and more particularly about 10 nm to about 200 nm and a length of about 0.5 μm to about 200 μm.

The dispersed nanoparticles 7 disclosed in the embodiments described herein may be embedded in the metallic material 9 of the metallic coating 6 so that a portion of the nanoparticles 7 interface with the surface 5 of the rotor 18. In an exemplary embodiment, portions of the nanoparticles 7 may protrude or project from surface 5. Having the nanoparticles 7 interface with the surface 5 allows a decreased frictional engagement to exist between the rotor 18 and matter that comes into contact with the surface 5, such as, for example, the polymer sleeve 22 and the mud 26. Further, where carbon nanoparticles, particularly carbon nanotubes, are used as dispersed nanoparticles 7, the coefficient of sliding friction of surface 5 may decrease with increasing load applied between first member 2, such as, for example, rotor 18, and second member 8, such as, for example, polymer sleeve 22. Metallic coatings 6, particularly those comprising Ni, that include dispersed carbon nanoparticles, particularly dispersed carbon nanotubes, generally have a lower coefficient of sliding friction and greater wear or abrasion resistance than those that utilize other nanoparticles, as well as conventional chromium hardcoats.

Metallic coating 6 having dispersed nanoparticles 7 disposed therein may be disposed on the surface 19 of substrate 15 using any suitable deposition method, including various plating methods, and more particularly including galvanic deposition methods. In an exemplary embodiment, a metallic coating 6 comprising Ni as metallic material 9 having a plurality of dispersed nanoparticles, particularly carbon nanoparticles, and more particularly carbon nanotubes, may be deposited by electroless deposition, electrodeposition or galvanic deposition using a nickel sulfate bath having a plurality of carbon nanoparticles dispersed therein. In another exemplary embodiment, a metallic coating 6 comprising an Ni—P alloy as metallic material 9 having a plurality of dispersed nanoparticles, particularly carbon nanoparticles, and more particularly carbon nanotubes, may be deposited by electroless deposition, electrodeposition or galvanic deposition using a bath that includes nickel sulfate and sodium hypophosphite that has plurality of carbon nanoparticles dispersed therein. In yet another exemplary embodiment, a metallic coating 6 comprising an Ni—W alloy as metallic material 9 having a plurality of dispersed nanoparticles 7, particularly carbon nanoparticles, and more particularly carbon nanotubes, may be deposited by electroless deposition, electrodeposition or galvanic deposition using a bath that includes nickel sulfate and sodium tungstate that has plurality of carbon nanoparticles dispersed therein. The carbon nanoparticles may include carbon nanotubes, particularly multi-wall carbon nanotubes. Metallic coatings that include a Ni—P alloy may be precipitation hardened to increase the hardness by annealing the metallic coating 6 sufficiently to cause precipitation of $Ni_3P$ precipitates.

In an exemplary embodiment, metallic coating 6 may include a plurality of spaced recesses 11 disposed in outer surface 5 as shown in FIG. 4. Spaced recesses 11 may be used to reduce the contact area between the outer surface 5 and an adjoining sliding surface and to capture a lubricant therein, thereby further reducing the coefficient of sliding friction of outer surface 5. Spaced recess 11 may be spaced uniformly in a repeating or a non-repeating pattern or randomly. Spaced recesses 11 may have any suitable size or shape. In an exemplary embodiment, spaced recesses have a maximum size of about 50 nm. In another exemplary embodiment, spaced recesses are generally cylindrical and have a maximum diametral size of about 50 nm.

In an exemplary embodiment, the surface 19 of the rotor substrate 15 on which the metallic coating 6 is disposed has a plurality of spaced pockets 13 formed therein as shown in FIG. 3, wherein deposition of the metallic coating 6 on the substrate coats the outer surface 19 and the surfaces of the spaced pockets 13. The spaced pockets 13 may have any suitable size and shape, including a generally cylindrical shape and a maximum size of about 10 mm.

The polymer sleeve 22 of the embodiments disclosed herein may also include carbon nanoparticles 42, including those described herein, embedded in the polymer material 24 to increase heat transfer through the polymer sleeve 22 into the stator 14, the rotor 18 and the mud 26, or other properties thereof. The increased heat transfer provided by the carbon nanoparticles 42 permits temperatures of the polymer sleeve 22 to more quickly adjust toward the temperatures of the stator 14, the rotor 18 and the mud 26 contacting the polymer sleeve 22 than would occur if the carbon nanoparticles 42 were not present.

The operating temperature of the polymer sleeve 22 can affect its durability. Typically, the relationship is such that the durability of the polymer sleeve 22 reduces as the temperature increases. Additionally, temperature thresholds exist, for specific materials, that when exceeded will significantly reduce the life of the polymer sleeve 22.

The elevated operating temperatures of the mud motor 10 are due, in part, to the high temperatures of the well environment in which the mud motor 10 operates. Additional temperature elevation, beyond that of the environment, is due, for example, to such things as frictional engagement of the polymer sleeve 22 with one or more of the stator 14, the rotor 18 and the mud 26, and to hysteresis energy, in the form of heat, developed in the polymer sleeve 22 during operation of the mud motor 10. This hysteresis energy comes from the difference in energy required to deform the polymer sleeve 22 and the energy recovered from the polymer sleeve 22 as the deformation is released. The hysteresis energy generates heat in the polymer sleeve 22, called heat build-up. It is these additional sources of heat generation within the polymer sleeve 22 that the addition of the nanoparticles 42 to the polymer sleeve 22, as disclosed herein, is added to mitigate. The use of carbon nanoparticles 7 in the metallic coating 6 of rotor 18 may also improve its heat transfer characteristics, thereby enabling more rapid transfer of heat from the polymer sleeve, thereby also contributing to its increased longevity.

Several parameters effect the additional heat generation, such as, the amount of dimensional deformation that the polymer sleeve 22 undergoes during operation, the frictional engagement between the polymer sleeve 22 and the rotor 18 and an overall length of the power section 46 of the mud motor 10, for example. Additional heat generation may be reduced with specific settings of these parameters, and the temperature of the polymer sleeve 22 or rotor 18 may be maintainable below predetermined threshold temperatures. Such settings of the parameters, however, may adversely affect the performance and efficiency of the mud motor 10, for example, by allowing more leakage therethrough, as well as increased operational and material costs associated therewith. Embodiments disclosed herein allow an increase in power density of a mud motor 10 by, for example, having a smaller overall mud motor 10 that produces the same amount of output energy to a bit 50 attached thereto without resulting in increased temperature of the polymer sleeve 22 or rotor 18. Additionally, the mud motor 10, using embodiments disclosed herein, may be able to operate at higher pressures without leakage between the polymer sleeve 22 and the rotor 18, thereby leading to higher overall motor efficiencies.

The carbon nanoparticles 42 disclosed in the embodiments described herein may be embedded in the polymer sleeve 22 so that the carbon nanoparticles 42 interface with a surface 54 of the polymer sleeve 22. Having the carbon nanoparticles 42 interface with the surface 54 allows a decrease frictional engagement to exist between the polymer sleeve 22 and matter that comes into contact with the surface 54, such as, the rotor 18 and the mud 26, for example. Such a decrease in friction can result in a corresponding decrease in heat generation. Additionally, in certain embodiments, the presence of the carbon nanoparticles 42 embedded within the polymer sleeve 22 decrease the hysteresis energy and heat generation resulting therefrom.

In one embodiment, the carbon nanoparticles 42 may be dispersed throughout the polymer sleeve 22. In another exemplary embodiment, the carbon nanoparticles may be dispersed on the surface 54 of the polymer sleeve that is in slidable engagement with the surface 5 of the rotor 18. The carbon nanoparticles may include fullerenes or graphenes, or a combination thereof. Fullerenes may include buckeyballs, buckeyball clusters, buckeypaper, single-wall nanotubes or multi-wall nanotubes, or a combination thereof.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A well tool, comprising:

a first member having a surface that is configured for exposure to a well fluid, the first member comprising a metallic coating disposed on a substrate, the metallic coating comprising an Ni—P alloy or an Ni—W alloy, the metallic coating having a plurality of dispersed nanoparticles disposed therein and providing the surface, the surface having a plurality of spaced recesses formed therein.

2. The tool of claim 1, wherein the metallic coating is an Ni—P alloy that comprises, by weight of the alloy, about 14 percent or less of P and the balance Ni and trace impurities.

3. The tool of claim 1, wherein the metallic coating is an Ni—W alloy that comprises, by weight of the alloy, about 30 percent or less of W and the balance Ni and trace impurities.

4. The tool of claim 1, wherein the nanoparticles comprise carbon, boron, a carbide, a nitride, an oxide, a boride or a solid lubricant, or a combination thereof.

5. The tool of claim 4, wherein the nanoparticles comprise fullerenes or graphenes, or a combination thereof.

6. The tool of claim 5, wherein the carbon nanoparticles comprise fullerenes selected from the group consisting of buckeyballs, buckeyball clusters, buckeypaper, single wall nanotubes or multi-wall nanotubes, or a combination thereof.

7. A well tool, comprising:

a first member having a surface that is configured for exposure to a well fluid, the first member comprising a metallic coating disposed on a substrate, the metallic coating comprising an alloy having an alloy base of Ni, Cu, Ag, Au, Zn, Sn, or Fe, or an alloy thereof, or a combination comprising at least one of the aforementioned materials, the metallic coating having a plurality of dispersed fullerene or graphene nanoparticles, or a combination thereof, disposed therein and providing the surface, the surface having a plurality of spaced recesses formed therein.

8. The tool of claim 7, wherein the first member comprises a rotor having the metallic coating disposed on an outer surface thereof.

9. The tool of claim 7, further comprising a second member that is disposed in slidable engagement on the surface of the first member.

10. The tool of claim 9, wherein the second member comprises a polymer sleeve or a metallic sleeve.

11. The tool of claim 8, wherein the tool comprises a drill string component.

12. The tool of claim 8, wherein the outer surface of the rotor comprises steel.

13. The tool of claim 7, wherein the carbon nanoparticles comprise fullerenes comprising buckeyballs, buckeyball clusters, buckeypaper, single wall nanotubes or multi-wall nanotubes, or a combination thereof.

14. The tool of claim 8, wherein the outer surface of the rotor is a bearing surface configured for sliding engagement with another member of the tool and has a plurality of spaced pockets formed therein, wherein the metallic coating coats the outer surface of the rotor substrate and the spaced pockets and provides the spaced recesses in the surface.

15. The tool of claim 14, wherein the spaced pockets have a maximum size of about 10 mm.

16. The tool of claim 15, wherein the spaced pockets are generally cylindrical.

17. The tool of claim 9, wherein the second member also comprises carbon nanoparticles.

18. The tool of claim 17, wherein the first member comprises a rotor, the second member comprises a polymer sleeve or a metal sleeve.

19. The tool of claim 18, wherein the carbon nanoparticles are dispersed throughout the polymer sleeve.

20. The tool of claim 18, wherein the carbon nanoparticles are dispersed on a surface of the polymer sleeve or metal sleeve that is in slidable engagement with the surface of the rotor.

21. The tool of claim 17, wherein the carbon nanoparticles comprise fullerenes or graphenes, or a combination thereof.

22. The tool of claim 21, wherein fullerenes comprise buckeyballs, buckeyball clusters, buckeypaper, single wall nanotubes or multi-wall nanotubes, or a combination thereof.

23. A well tool, comprising:

a first member having a surface that is configured for exposure to a well fluid, the first member comprising a metallic coating disposed on a substrate, the metallic coating having a plurality of dispersed nanoparticles disposed therein and providing the surface, the surface having a plurality of spaced recesses formed therein, wherein the spaced recesses have a maximum size of about 50 nm.

24. The tool of claim 23, wherein the nanoparticles comprise carbon, boron, a carbide, a nitride, an oxide, a boride or a solid lubricant, or a combination thereof.

25. A well tool, comprising:

a first member having a surface that is configured for exposure to a well fluid, the first member comprising a metallic coating disposed on a substrate, the metallic coating having a plurality of dispersed nanoparticles disposed therein and providing the surface, the surface having a plurality of spaced recesses formed therein, wherein the spaced recesses are generally cylindrical and have a maximum diametral size of about 50 nm.

* * * * *